US007903991B2

(12) United States Patent
Monahan et al.

(10) Patent No.: US 7,903,991 B2
(45) Date of Patent: Mar. 8, 2011

(54) METHOD AND APPARATUS FOR MEASURING NIP WIDTH IN AN IMAGE PRODUCTION DEVICE

(75) Inventors: Melissa Ann Monahan, Rochester, NY (US); William Alexander Burton, Fairport, NY (US); Paul M. Fromm, Rochester, NY (US); Stephen Bradley Williams, Marion, NY (US); Julie Marie Hanfland, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 170 days.

(21) Appl. No.: 12/335,591

(22) Filed: Dec. 16, 2008

(65) Prior Publication Data

US 2010/0150585 A1 Jun. 17, 2010

(51) Int. Cl.
*G03G 15/20* (2006.01)

(52) U.S. Cl. ..... 399/67; 399/322; 399/328

(58) Field of Classification Search ..... 399/33, 399/67, 68, 322, 328; 347/156
See application file for complete search history.

(56) References Cited

U.S. PATENT DOCUMENTS

| | | | | |
|---|---|---|---|---|
| 4,397,097 | A * | 8/1983 | Damrau et al. | 33/657 |
| 5,598,639 | A * | 2/1997 | Webb | 33/784 |
| 6,819,890 | B1 | 11/2004 | Bott et al. | |
| 2005/0220473 | A1 * | 10/2005 | Bott et al. | 399/67 |

* cited by examiner

*Primary Examiner* — Sandra L Brase
(74) *Attorney, Agent, or Firm* — Ronald E. Prass, Jr.; Prass LLP

(57) ABSTRACT

A method and apparatus for measuring nip width in an image production device is disclosed. The method may include receiving a signal to measure the nip width, the nip width being the distance of an arc length created by an intersection of a fuser roll and a pressure roll, positioning a nip width measuring device into the nip, measuring the nip width, determining if the measured nip width meets a required nip width, wherein if the measured nip width does not meet the required nip width, adjusting the nip width.

18 Claims, 3 Drawing Sheets

METHOD AND APPARATUS FOR MEASURING NIP WIDTH IN AN IMAGE PRODUCTION DEVICE

BACKGROUND

Disclosed herein is a method for measuring nip width in an image production device, as well as corresponding apparatus and computer-readable medium.

The nip width is the measured arc distance created by an intersection of a soft fuser roll and a hard pressure roll in an image production device, such as a printer, copier, multi-function device, etc. If the nip width is not set properly, media sheets will not be fused (fixed) properly and cause toner (dry ink) to rub off on the prints. In addition an inadequately set nip results in accelerated roll surface wear and non-optimum gloss levels on the prints.

In conventional image production devices, the current nip set up procedure requires the operator to manually load a blank piece of paper into the fuser nip to make an impression, dust the impression with toner, and then measure the nip width with a small scale. This manual process leads to nip width variability. Nip width variability inboard to outboard along the fuser and pressure rolls can cause fuser roll edge wear, which results in significant delta gloss variability.

SUMMARY

A method and apparatus for measuring nip width in an image production device is disclosed. The method may include receiving a signal to measure the nip width, the nip width being the distance of an arc length created by an intersection of the fuser roll and the pressure roll, positioning a nip width measuring device into the nip, measuring the nip width, determining if the measured nip width meets a required nip width, wherein if the measured nip width does not meet the required nip width, adjusting the nip width.

DETAILED DESCRIPTION

Figure 1:
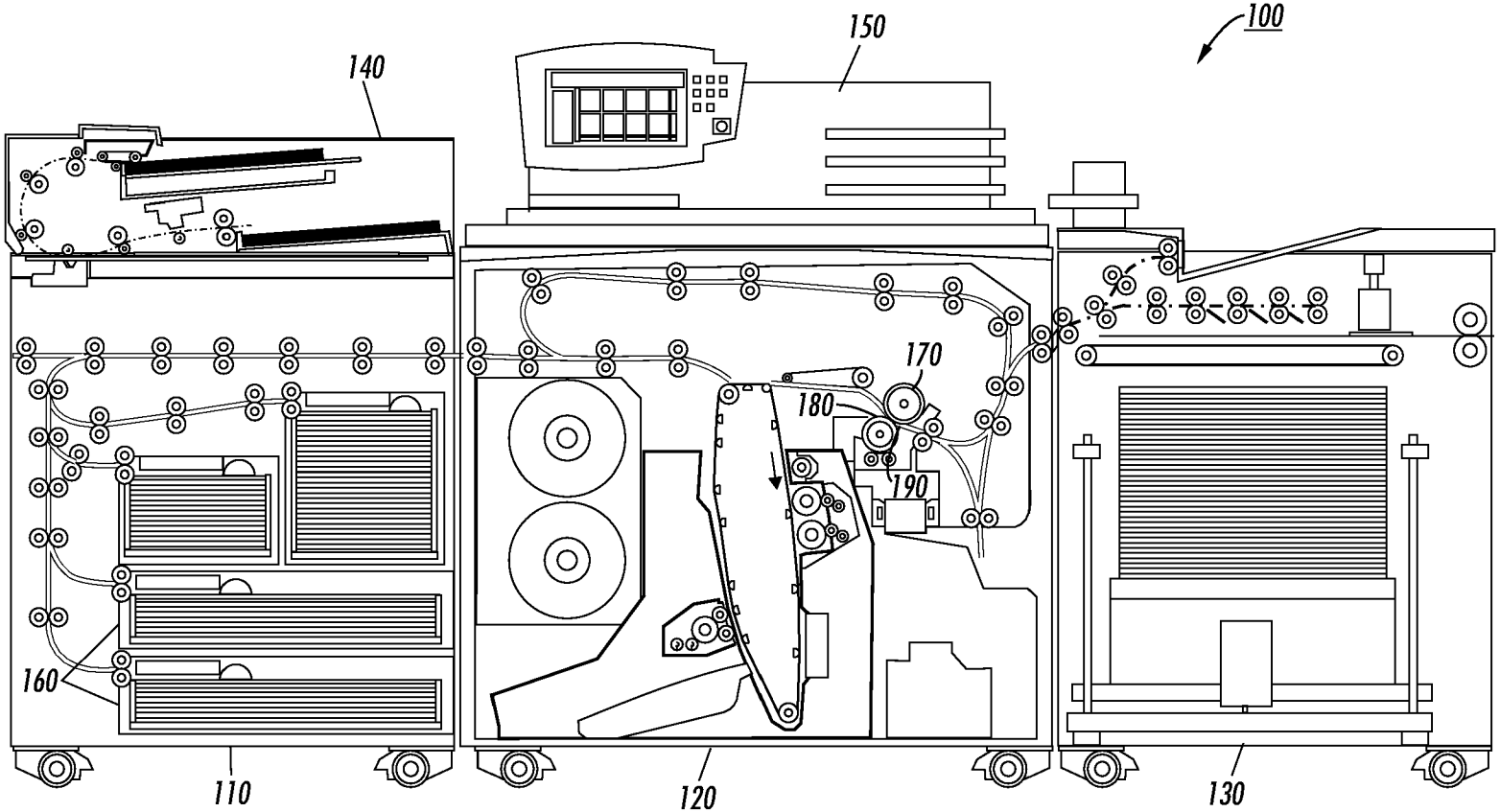
FIG. 1 is an exemplary diagram of an image production device in accordance with one possible embodiment of the disclosure.

Aspects of the embodiments disclosed herein relate to a method for measuring nip width in an image production device, as well as corresponding apparatus and computer-readable medium.

The disclosed embodiments may include a method for measuring nip width in an image production device. The method may include receiving a signal to measure the nip width, the nip width being the distance of an arc length created by an intersection of the fuser roll and the pressure roll, positioning a nip width measuring device into the nip, measuring the nip width, determining if the measured nip width meets a required nip width, wherein if the measured nip width does not meet the required nip width, adjusting the nip width.

The disclosed embodiments may further include an image production device that may include a nip width measurement unit that includes a nip width measuring device that measures the nip width, the nip width being the distance of an arc length created by an intersection of the fuser roll and the pressure roll, and a nip width adjustment unit that receives a signal to measure the nip width, positions the nip width measuring device into the nip, receives the nip width measurement from the nip width measuring device, determines if the measured nip width meets a required nip width, wherein if the nip width adjustment unit determines that the measured nip width does not meet the required nip width, the nip width adjustment unit adjusts the nip width.

The disclosed embodiments may further include a computer-readable medium storing instructions for controlling a computing device for measuring nip width in an image production device. The instructions may include receiving a signal to measure the nip width, the nip width being the distance of an arc length created by an intersection of the fuser roll and the pressure roll, positioning a nip width measuring device into the nip, measuring the nip width, determining if the measured nip width meets a required nip width, wherein if the measured nip width does not meet the required nip width, adjusting the nip width.

The disclosed embodiments may concern a method and apparatus for measuring nip width in an image production device. A measuring device such as a linear probe may contact the fuser roll nip exit from a datum to determine the nip ½ width. This procedure may be used for initial nip set up and nip checks after each fuser roll change or a periodic check, for example. The probe may have a mechanical display or an electronic output that could be sent to the user interface or be used for automatic nip adjustment.

The measuring device may use a spring loaded probe to measure the nip width on the inboard and outboard ends of the fuser roll to pressure roll nip. The probe may be either a simple mechanical scale or a linear transducer, for example, that produces a signal that could be used to adjust the nip width automatically. The probe may also be implemented in a single or double probe configuration.

The benefits of this process include:

- The process may not require opening and closing of the rolls set to imprint the nip.
- The process may reduce the number of steps involved in the current procedure.
- The process may reduce variation from the manual method.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module may include any number of trays 160, each of which may store a media stack or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack by use of an air knife, fluffer, vacuum grip or other application (not shown in the Figure) of air pressure toward the top sheet or sheets in a media stack. Certain types of coated media are advantageously drawn from a media stack by the use of an application of heat, such as by a stream of hot air (not shown in the Figure). Sheets of media drawn from a media stack on a selected tray 160 may then be moved to the image production section 120 to receive one or more images thereon.

In this embodiment, the image production section 120 is shown to be a monochrome xerographic type engine, although other types of engines, such as color xerographic, ionographic, or ink-jet may be used. In FIG. 1, the image production section 120 may include a photoreceptor which may be in the form of a rotatable belt. The photoreceptor may be called a "rotatable image receptor," meaning any rotatable structure such as a drum or belt which can temporarily retain one or more images for printing. Such an image receptor can comprise, by way of example and not limitation, a photoreceptor, or an intermediate member for retaining one or more marking material layers for subsequent transfer to a sheet, such as in a color xerographic, offset, or ink-jet printing apparatus.

The photoreceptor may be entrained on a number of rollers, and a number of stations familiar in the art of xerography are placed suitably around the photoreceptor, such as a charging station, imaging station, development station, and transfer station. In this embodiment, the imaging station is in the form of a laser-based raster output scanner, of a design familiar in the art of "laser printing," in which a narrow laser beam scans successive scan lines oriented perpendicular to the process direction of the rotating photoreceptor. The laser may be turned on and off to selectably discharge small areas on the moving photoreceptor according to image data to yield an electrostatic latent image, which is developed with marking material at development station and transferred to a sheet at transfer station.

A sheet having received an image in this way is subsequently moved through fuser section that may include a fuser roll 170 and a pressure roll 180, of a general design known in the art, and the heat and pressure from the fuser nip causes the marking material image to become substantially permanent on the sheet. The nip width 190 is shown as the distance of an arc length created by an intersection of the fuser roll 170 and the pressure roll 180. The sheet once printed, may then be moved to output section 130, where it may be collated, stapled, folded, etc., with other media sheets in a manner familiar in the art.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Figure 2:
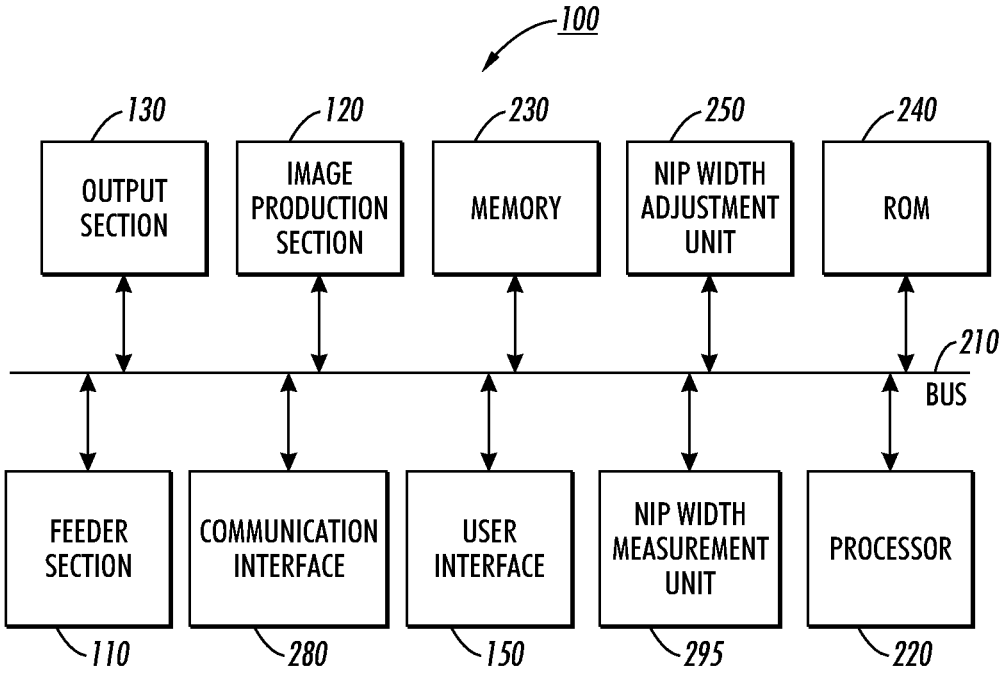
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a nip width adjustment unit 250, a feeder section 110, an output section 130, a user interface 150, a communication interface 280, an image production section 120, and a nip width measurement unit 295. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
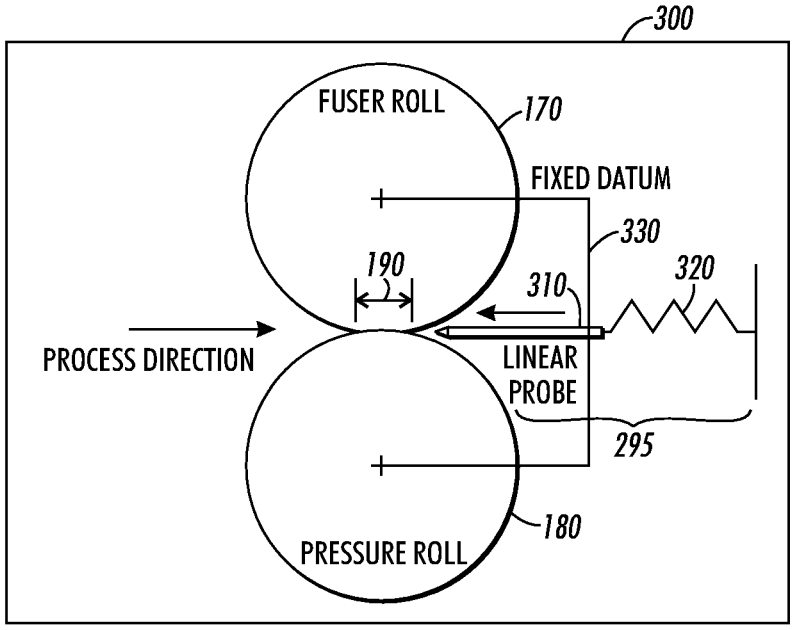
FIG. 3 is an exemplary diagram of the nip width measurement environment in accordance with one possible embodiment of the disclosure.

FIG. 3 is an exemplary diagram of the nip width measurement environment in accordance with one possible embodiment of the disclosure. The nip width measurement environment 300 may be found in the image production section 120 and may include fuser roll 170, pressure roll 180, and nip width measurement unit 295. The nip width measurement unit 295 may include any device that may automatically be positioned to measure the nip width 190. In the exemplary embodiment shown, the nip width measurement unit 295 may include a linear probe 310 which may be extended by a spring 320, for example. The probe 310 may be a mechanical scale or a linear transducer, for example. However, as one of skill in the art may recognize, other configurations of automatically measuring the nip width may be used.

The fuser roll 170 and pressure roll 180 are positioned at a fixed datum 330. If the measurement process of the disclosed embodiments dictates, the nip width adjustment unit 250 may change the nip width 190 by adjusting the distance between the fuser roll 170 and the pressure roll 180. Note however, that while the disclosed embodiments concern a nip width 190 the distance of an arc length created by an intersection of the fuser roll 170 and the pressure roll 180, the disclosed process may be applied to any two rolls in an image production device 100 where the rolls must be properly adjusted to allow media to pass through without jamming.

The operation of components of the nip width adjustment unit 250, the nip width measurement unit 295, and the nip width measurement process will be discussed in relation to the flowchart in FIG. 4.

Figure 4:
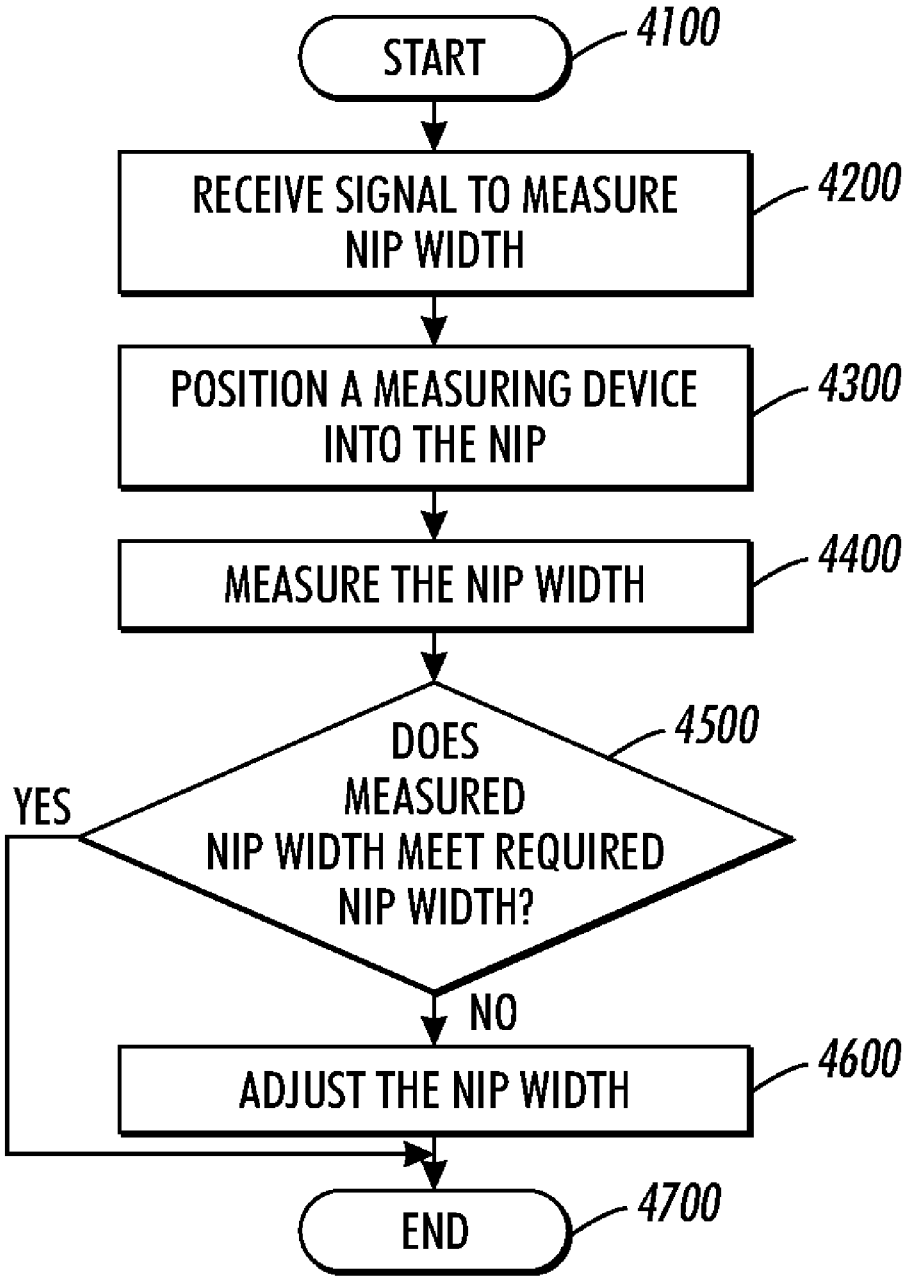
FIG. 4 is a flowchart of an exemplary nip width measuring process in accordance with one possible embodiment of the disclosure.

FIG. 4 is a flowchart of an exemplary nip width measurement process in accordance with one possible embodiment of the disclosure. The method begins at 4100, and continues to 4200 where the nip width adjustment unit 250 may receive a signal to measure the nip width 190. The nip width 190 may be measured automatically upon fuser roll 170 replacement or on a periodic basis, for example. At step 4300, the nip width adjustment unit 250 may position the nip width measuring device 310 into the nip 190. At step 4400, the nip width measuring device 310 measures the nip width 190 and the nip width adjustment unit 250 receives the nip width measurement from the nip width measuring device 310. The nip width 190 may be measured on at least each edge of the fuser roll 170 for example.

At step 4500, the nip width adjustment unit 250 may determine if the measured nip width 190 meets a required nip width. If the nip width adjustment unit 250 determines that the measured nip width 190 meets the required nip width, the process may then go to step 4700 and end. If the nip width adjustment unit determines that the measured nip width 190 does not meet the required nip width, at step 4600, the nip width adjustment unit 250 may adjust the nip width 190. The nip width measurement may also be displayed on the user interface 150, for example. The process may then go to step 4700 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for measuring nip width in an image production device, comprising:

receiving a signal to measure the nip width, the nip width being the distance of an arc length created by an intersection of a fuser roll and a pressure roll;

positioning a nip width measuring device into the nip, wherein the nip width measuring device is a probe and the probe is extended by a spring;

measuring the nip width; and determining if the measured nip width meets a required nip width, wherein if the measured nip width does not meet the required nip width, adjusting the nip width.

2. The method of claim 1, wherein the nip width measuring device is a probe that is one of a mechanical scale and a linear transducer.

3. The method of claim 1, wherein the nip width is measured automatically upon at least one of fuser roll replacement and on a periodic basis.

4. The method of claim 1, wherein the nip width is measured on at least each edge of the fuser roll.

5. The method of claim 1, wherein the nip width measurement is displayed on a user interface.

6. The method of claim 1, wherein the image production device is one of a copier, a printer, a facsimile device, and a multi-function device.

7. An image production device, comprising:

a nip width measurement unit that includes a nip width measuring device that measures the nip width, the nip width being the distance of an arc length created by an intersection of a fuser roll and a pressure roll, wherein the nip width measuring device is a probe and the probe is extended by a spring; and a nip width adjustment unit that receives a signal to measure the nip width, positions the nip width measuring device into the nip, receives the nip width measurement from the nip width measuring device, determines if the measured nip width meets a required nip width, wherein if the nip width adjustment unit determines that the measured nip width does not meet the required nip width, the nip width adjustment unit adjusts the nip width.

8. The image production device of claim 7, wherein the nip width measuring device is a probe that is one of a mechanical scale and a linear transducer.

9. The image production device of claim 7, wherein the nip width measuring device measures the nip width automatically upon at least one of fuser roll replacement and on a periodic basis.

10. The image production device of claim 7, wherein the nip width measuring device measures the nip width on at least each edge of the fuser roll.

11. The image production device of claim 7, wherein the nip width measurement is displayed on a user interface.

12. The image production device of claim 7, wherein the image production device is one of a copier, a printer, a facsimile device, and a multi-function device.

13. A computer-readable medium storing instructions for controlling a computing device for measuring nip width in an image production device, the instructions comprising:

receiving a signal to measure the nip width, the nip width being the distance of an arc length created by an intersection of a fuser roll and a pressure roll;

positioning a nip width measuring device into the nip, wherein the nip width measuring device is a probe and the probe is extended by a spring;

measuring the nip width;

determining if the measured nip width meets a required nip width, wherein if the measured nip width does not meet the required nip width, and adjusting the nip width.

14. The computer-readable medium of claim 13, wherein the nip width measuring device is a probe that is one of a mechanical scale and a linear transducer.

15. The computer-readable medium of claim 13, wherein the nip width is measured automatically upon at least one of fuser roll replacement and on a periodic basis.

16. The computer-readable medium of claim 13, wherein the nip width is measured on at least each edge of the fuser roll.

17. The computer-readable medium of claim 13, wherein the nip width measurement is displayed on a user interface.

18. The computer-readable medium of claim 13, wherein the image production device is one of a copier, a printer, a facsimile device, and a multi-function device.

* * * * *